US006140030A

United States Patent [19]

Anderson et al.

[11] Patent Number: 6,140,030

[45] Date of Patent: Oct. 31, 2000

[54] PHOTOGRAPHIC ELEMENT CONTAINING TWO ELECTRICALLY-CONDUCTIVE AGENTS

[75] Inventors: Charles C. Anderson, Penfield; Mario D. DeLaura, Hamlin, both of N.Y.

[73] Assignee: Eastman Kodak Company, Rochester, N.Y.

[21] Appl. No.: 09/305,934

[22] Filed: May 6, 1999

[51] Int. Cl.[7] ..... G03C 1/85; G03C 1/89

[52] U.S. Cl. ..... 430/529; 430/527; 430/528; 430/532

[58] Field of Search ..... 430/527–530

[56] References Cited

U.S. PATENT DOCUMENTS

| | | | |
|---|---|---|---|
| 2,627,088 | 2/1953 | Alles et al. . | |
| 2,698,235 | 12/1954 | Swindells . | |
| 2,698,240 | 12/1954 | Alles et al. . | |
| 2,943,937 | 7/1960 | Nadeau et al. . | |
| 3,143,421 | 8/1964 | Nadeau et al. . | |
| 3,201,249 | 8/1965 | Pierce . | |
| 3,271,178 | 9/1966 | Nadeau et al. . | |
| 3,501,301 | 3/1970 | Nadeau . | |
| 4,070,189 | 1/1978 | Kelley et al. | 430/528 |
| 4,186,891 | 2/1980 | Johnson | 242/55.19 R |
| 4,203,769 | 5/1980 | Guestaux | 430/631 |
| 4,208,018 | 6/1980 | Wilkinson | 242/55.19 R |
| 4,237,194 | 12/1980 | Upson et al. | 430/527 |
| 4,275,103 | 6/1981 | Tsubusaki et al. | 430/67 |
| 4,394,441 | 7/1983 | Kawaguchi et al. | 430/527 |
| 4,416,963 | 11/1983 | Takimoto et al. | 430/69 |
| 4,418,141 | 11/1983 | Kawaguchi et al. | 430/527 |
| 4,431,764 | 2/1984 | Yoshizumi | 524/409 |
| 4,495,276 | 1/1985 | Takimoto et al. | 430/527 |
| 4,571,361 | 2/1986 | Kawaguchi et al. | 428/328 |
| 4,845,369 | 7/1989 | Arakawa et al. | 250/484.1 |
| 4,999,276 | 3/1991 | Kawabara et al. | 430/527 |
| 5,006,451 | 4/1991 | Anderson et al. | 430/527 |
| 5,122,445 | 6/1992 | Ishigaki | 430/527 |
| 5,166,666 | 11/1992 | Tanaka | 340/706 |
| 5,368,995 | 11/1994 | Christian et al. | 430/530 |
| 5,370,981 | 12/1994 | Krafft et al. | 430/527 |
| 5,376,517 | 12/1994 | Kurachi et al. | 430/530 |
| 5,679,505 | 10/1997 | Tingler et al. | 430/527 |
| 5,719,016 | 2/1998 | Christian et al. | 430/530 |
| 5,731,119 | 3/1998 | Eichorst et al. | 430/530 |
| 5,747,232 | 5/1998 | Anderson et al. | 430/527 |

FOREIGN PATENT DOCUMENTS

| | | |
|---|---|---|
| 2282245 | 11/1990 | Japan . |
| 2282248 | 11/1990 | Japan . |
| 4055492 | 2/1992 | Japan . |

OTHER PUBLICATIONS

R.A. Elder, "Resistivity Measurements on Buried Conductive Layers," EOS/ESD Symposium proceedings, Sep. 1990, pp. 251–254.

Research Disclosure # 36544 "Photographic Silver Halide Emulsions, Prepartions, Addenda, Systems and Processing", Sep. 1994.

Research Disclosure # 308119 "Coating and drying procedures", Dec. 1989, pp. 1007–1008.

*Primary Examiner*—Richard L. Schilling
*Attorney, Agent, or Firm*—Doreen M. Wells

[57] ABSTRACT

In accordance with the present invention a photographic element contains a first electrically-conductive layer and a second electrically-conductive layer. The first conductive layer has an electrical resistivity of less than $1\times10^9$ Ω/□ before film processing and an electrical resistivity of greater than $1\times10^{11}$ Ω/□ after film processing. The second conductive layer has an electrical resistivity of between $1\times10^9$ Ω/□ and $1\times10^{11}$ Ω/□ both before and after film processing. Both of the electrically-conductive layers are transparent. In an alternative embodiment, the photographic element contains a transparent electrically-conductive layer containing a first electrically-conductive agent and a second electrically-conductive agent. The electrically-conductive layer has an electrical resistivity of less than $1\times10^9$ Ω/□ before film processing and has an electrical resistivity of between $1\times10^9$ Ω/□ and $1\times10^{11}$ Ω/□ after film processing. The first conductive agent is one in which the conductive properties of the material do not survive film processing. The second conductive agent is one in which the conductive properties of the material are substantially unaffected as a result of film processing.

23 Claims, 2 Drawing Sheets

PHOTOGRAPHIC ELEMENT CONTAINING TWO ELECTRICALLY-CONDUCTIVE AGENTS

FIELD OF THE INVENTION

The present invention relates to photographic elements containing a support, one or more imaging forming layers, and one or more electrically-conductive layers. More particularly, this invention relates to a photographic element containing two different electrically-conductive layers or, alternatively, the imaging element may contain one electrically-conductive layer containing two different electrically-conductive agents. The use of two conductive layers or, alternatively, a conductive layer containing two different conductive agents provides an imaging element that has antistatic properties that can be optimized for all phases of its manufacture and use.

BACKGROUND OF THE INVENTION

The problem of controlling electrostatic charge is well known in the field of photography. It is also generally known that electrostatic charge can usually be effectively controlled by incorporating an electrically-conductive "antistatic" layer into the film structure. An antistatic layer can be applied to either side of the film base as a subbing layer, that is, beneath the imaging layer or on the side opposite to the imaging layer. An antistatic layer can alternatively be applied as an outer coated layer either over the emulsion layers or on the side of the film base opposite to the emulsion layers (i.e., the backside of the film). For some applications, the antistatic agent can be incorporated into the emulsion layers. Alternatively, the antistatic agent can be directly incorporated into the film base itself. Typically, however, the antistatic layer is employed on the backside of the film and frequently it underlies an abrasion resistant, protective topcoat.

A wide variety of electrically-conductive materials can be incorporated into antistatic layers to produce a wide range of conductivity. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. These antistatic layers generally exhibit a substantial loss of antistatic function as a result of exposure to photographic processing solutions.

Antistatic layers containing electronic conductors such as conjugated conducting polymers, conducting carbon particles, crystalline semiconductor particles, amorphous semiconductive fibrils, and continuous semiconducting thin films can be used more effectively than ionic conductors to dissipate static charge since their electrical conductivity is independent of relative humidity and only slightly influenced by ambient temperature. The antistatic properties of such electronic conductors may or may not be affected by photographic processing depending on the particular material. Of the various types of electronic conductors, electrically conducting metal-containing particles, such as semiconducting metal oxides, are particularly effective when dispersed in suitable polymeric film-forming binders in combination with polymeric non-film-forming particles as described in U.S. Pat. Nos. 5,340,676; 5,466,567; 5,700,623. Binary metal oxides doped with appropriate donor heteroatoms or containing oxygen deficiencies have been disclosed in prior art to be useful in antistatic layers for photographic elements, for example, U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; 5,484,694 and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include antimony-doped tin oxide, fluorine-doped tin oxide, aluminum-doped zinc oxide, and niobium-doped titania. Additional preferred conductive ternary metal oxides disclosed in U.S. Pat. No. 5,368,995 include zinc antimonate and indium antimonate. Other conductive metal-containing granular particles including metal borides, carbides, nitrides and suicides have been disclosed in Japanese Kokai No. JP 04-055,492.

The generation and accumulation of electrostatic charge on film or paper surfaces leads to a variety of problems associated with the manufacture and use of these products. For example, electrostatic charge promotes the attraction of dirt and dust which can lead to these particles being imaged on the film during exposure or printed or projected when these particles are attracted to an already exposed and processed product such as a negative, slide, or motion picture print film. The discharge of accumulated charge during or after the application of the sensitized emulsion layer(s) can produce irregular fog patterns or "static marks" in the emulsion. The static problems have been aggravated by increases in the sensitivity of new emulsions, increases in coating machine speeds, and increases in post-coating drying efficiency. Electrostatic charge can accumulate during winding and unwinding operations, during transport through the coating machines and during finishing operations such as slitting and spooling. Electrostatic charge can also be generated during the use of the finished photographic film product. In an automatic camera, the winding of roll film in an out of the film cartridge, especially in a low relative humidity environment, can result in static charging. Similarly, high speed automated film processing can result in static charge generation. Sheet films (e.g., x-ray films) are especially susceptible to static charging during removal from light-tight packaging.

The use of conductive or antistatic layers on photographic products has greatly minimized many of these abovementioned problems associated with electrostatic charge. However, only very recently has it become recognized that the use of a conductive layer can actually exacerbate some static-related problems. When an electrostatic charge is generated on an insulating surface which overlies a buried conductive layers or is on the side of the film opposite to a conductive layer, the conductive layer is unable to dissipate this surface charge. Instead, the conductive layer can "image" the charge by polar charge formation (that is, the conductive layer is able to draw up an equal, but, opposite charge to that on the surface layer). The formation of this image charge or polar charge within the conductive layer effectively collapses the external field generated by the surface charge so that the field becomes internalized within the film. The presence of an external field could otherwise attract airborne dirt and dust particles to the film surface which can lead to several problems already discussed. In this case then, the presence of the conductive layer and the formation of polar charge helps to eliminate a static-related problem, namely dirt and dust attraction. Referring now to FIG. 1 of the prior art, which schematically illustrates the cross-sectional view of an imaging element such as a photographic film, the polymer substrate 12 is provided with an insulating, image forming layer 10 on its front surface and a conductive layer 14 on its back surface. During conveyance of the imaging element, the image forming layer 10, as a result of contact with dissimilar materials such as rollers or other surfaces, may develop a positive electrostatic charge. The conductive layer 14 then forms an image charge so that the electric field E is internalized within the imaging element.

However, the formation of polar charge can lead to a variety of film sticking problems when the image charge within the conductive layer on one side of the film couples to the (opposite sign) surface charge on the other side of on an adjacent lap of film within a roll or on another sheet of film that it is in contact with. Referring now to FIG. 2 of the prior art, which schematically illustrates this film sticking phenomenon, a film 20 which may be present as a sheet of film or a lap of film on a roll, contains a polymer substrate 26, an insulating, image forming layer 24 on its front surface and a conductive layer 28 on its back surface. Likewise, a film 22, which again may be present as a sheet of film or a lap of film on a roll which is adjacent to film 20, contains a polymer substrate 32, an image forming layer 30, and a conductive layer 34. Both films 20 and 22 have a positive surface charge on imaging layers 24 and 30, respectively, and an image charge in the conductive layers 28 and 34, respectively.

An electrostatic attraction force exists between the positively charged image forming layer 30 of film 22 and the negatively charged conductive layer 28 of film 20. This force of attraction increases as the distance between the two films is decreased and results in the sticking together of these two sheets of film or alternatively two adjacent laps of film. Examples where this film sticking has been observed include sheet films such as graphic arts films, microfiche, and x-ray films that contain a conductive layer whose conductive properties survive film processing. Such films become charged as a result of contact with rollers during film processing and can cause jams in the film processor or difficulties in handling the films after processing.

For motion picture print films containing a conductive layer such as those described in U.S. Pat. No. 5,679,505, film sticking may cause jams in film projectors employing endless loop platter systems such as those described in U.S. Pat. Nos. 4,186,891, 4,208,018, and others. Referring now to FIG. 3 of the prior art, which schematically illustrates this platter sticking problem, an endless loop platter system 30 contains an inner lap of film 32 which is pulled from the core of the film roll and transported along film path 36 to the film projector. The film is rewound onto the outer lap of the film roll via film path 38 as it returns from the projector. As a result of film sticking due to the process already described in FIG. 2, when inner lap 32 is drawn from the core of the roll it may stick to the adjacent lap 34. Film lap 34 may in turn stick to the adjacent outer lap, and so on. Thus multiple laps of film may be pulled simultaneously from the core of the film roll and become jammed in the platter system potentially damaging the projector system, the film, or both.

Increasing the resistivity (or decreasing the conductivity) of a conductive or antistatic layer contained on an imaging element to greater than about $1\times10^9$ Ω/□ can reduce the tendency for the above sticking problems. However, by increasing the resistivity of the conductive layer one may also significantly reduce overall antistatic protection provided by the conductive layer. In particular, the layer may not be sufficiently conductive to prevent static marking of the film during high speed finishing operations such as film slitting, chopping, or perforating. Although it may be possible to optimize the resistivity of the film so that static protection in finishing operations is provided while film sticking is eliminated, simultaneously achieving both of these attributes is a very difficult challenge.

It is an object of the present invention to provide an improved imaging element which effectively minimizes both film sticking and static marking caused by electrostatic charge.

SUMMARY OF THE INVENTION

In accordance with the present invention a photographic element contains a first electrically-conductive layer and a second electrically-conductive layer. The first conductive layer has an electrical resistivity of less than $1\times10^9$ Ω/□ before film processing and an electrical resistivity of greater than $1\times10^{11}$ Ω/□ after film processing. The second conductive layer has an electrical resistivity of between $1\times10^9$ Ω/□ and $1\times10^{11}$ Ω/□ both before and after film processing. Both of the electrically-conductive layers are transparent.

In an alternative embodiment, the photographic element contains a transparent electrically-conductive layer containing a first electrically-conductive agent and a second electrically-conductive agent. The electrically-conductive layer has an electrical resistivity of less than $1\times10^9$ Ω/□ before film processing and has an electrical resistivity of between $1\times10^9$ Ω/□ and $1\times10^{11}$ Ω/□ after film processing. The first conductive agent is one in which the conductive properties of the material do not survive film processing. The second conductive agent is one in which the conductive properties of the material are substantially unaffected as a result of film processing.

Imaging elements of the invention containing two conductive layers, or alternatively a single conductive layer containing two conductive agents, provides the imaging element with optimum antistatic protection during all phases of manufacture and use.

Figure 1:
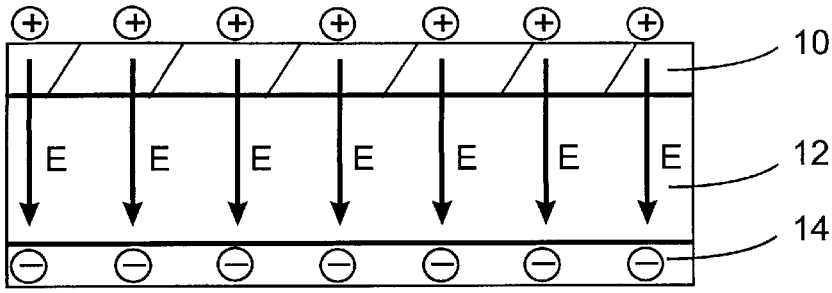
FIG. 1 (PRIOR ART)
FIG. 1 is a schematic diagram of the cross-section of an imaging element of the prior art.
Figure 2:
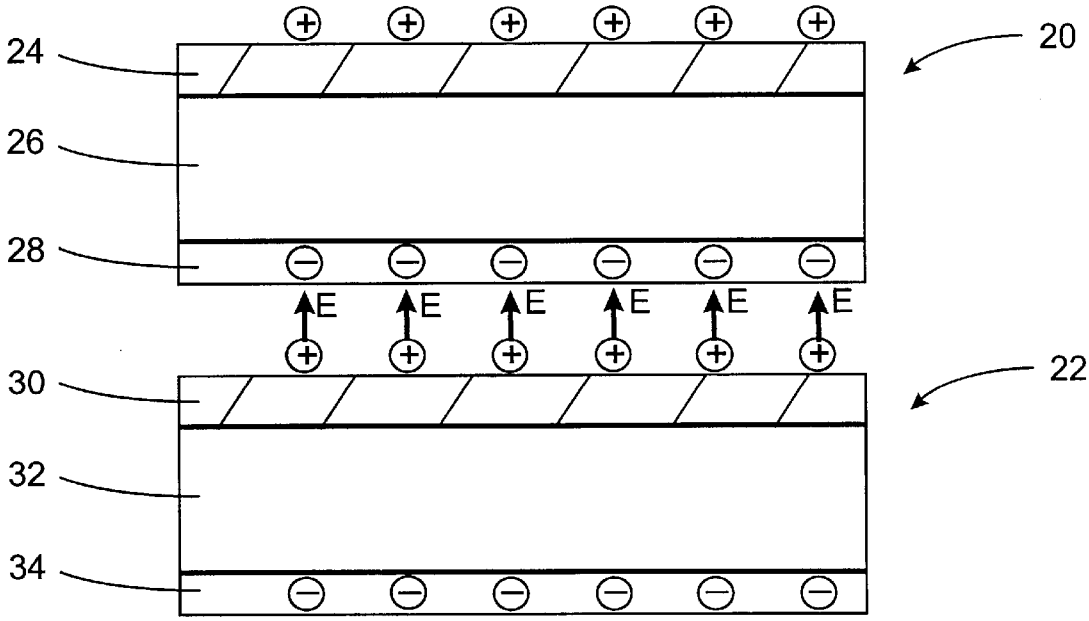
FIG. 2 (PRIOR ART)
FIG. 2 is a schematic diagram showing two films of the prior art sticking together as a result of electrostatic attraction.
Figure 3:
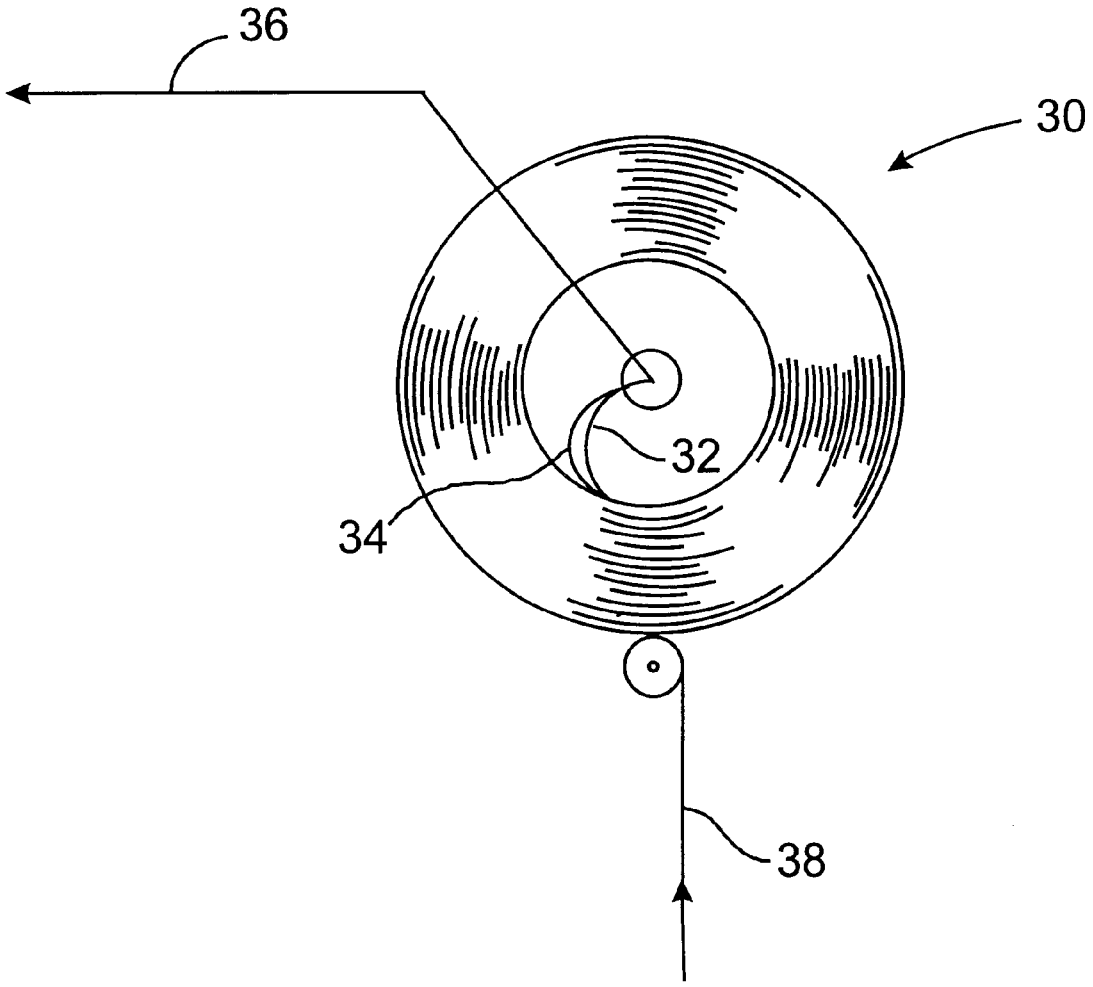
FIG. 3 (PRIOR ART)
FIG. 3 is a schematic diagram showing how a film of the prior art can create jams in a motion picture projector endless loop platter system.

For a better understanding of the present invention together with other advantages and capabilities thereof, reference is made to the following detailed description and claims in connection with the above described drawings.

DETAILED DESCRIPTION OF THE INVENTION

The present invention relates to photographic elements containing a support, one or more imaging forming layers, and one or more electrically-conductive layers. More particularly, this invention relates to an imaging element containing two different electrically-conductive layers or, alternatively, the photographic element may contain one electrically-conductive layer containing two different electrically-conductive agents. The use of two conductive layers or, alternatively, a conductive layer containing two different conductive agents provides an imaging element that has antistatic properties that can be optimized for all phases of its manufacture and use.

The support materials used in the practice of the invention can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The thickness of the support is not critical. Support thickness of 2 to 10 mils (0.002–0.010 inches) can be employed, for example, with very satisfactory results. To promote adhesion, an undercoat or primer layer is typically employed on polyester support. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088; 2,698,235; 2,698,240; 2,943,937; 3,143,421; 3,201,249; 3,271,178; and 3,501,301.

In a particularly preferred embodiment, the photographic elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. Details regarding other layers of the photographic elements of this invention are contained in *Research Disclosure,* Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

In accordance with the present invention a photographic element contains a first electrically-conductive layer and a second electrically-conductive layer. The first conductive layer has an electrical resistivity of less than $1\times10^{9}$ Ω/□ before film processing and has an electrical resistivity of greater than $1\times10^{11}$ Ω/□ after film processing. The second conductive layer has an electrical resistivity of between $1\times10^{9}$ Ω/□ and $1\times10^{11}$ Ω/□ both before and after film processing. Both of the electrically-conductive layers are transparent.

Electrically-conductive agents for use in the first electrically-conductive layer are those whose conductive properties are substantially diminished as a result of film processing. These include conductive agents such as simple inorganic salts, alkali metal salts of surfactants, ionic conductive polymers, polymeric electrolytes containing alkali metal salts, and colloidal metal oxide sols (stabilized by metal salts). Of these, ionic conductive polymers such as anionic alkali metal salts of styrene sulfonic acid copolymers and cationic quaternary ammonium polymers of U.S. Pat. No. 4,070,189 and ionic conductive colloidal metal oxide sols which include silica, tin oxide, titania, antimony oxide, zirconium oxide, alumina-coated silica, alumina, boehmite, and smectite clays are preferred. A colloidal gel of vanadium pentoxide or silver-doped vanadium pentoxide as described in U.S. Pat. Nos. 4,203,769; 5,006,451; and others is known to lose conductive properties as a result of film processing unless overcoated with a barrier layer or protective overcoat that resists film processing solutions. This colloidal gel of vanadium pentoxide or silver-doped vanadium pentoxide could therefore be employed in the first electrically-conductive layer of the invention without an overlying barrier layer so that its conductive properties will be lost during film processing.

Electrically-conductive agents for use in the second electrically-conductive layer are preferably those whose conductive properties are inherently stable toward photographic processing solutions, i.e., the conductive properties of the electrically conductive agent are substantially unaffected by film processing. These preferred electrically-conductive agents include:

1) electronic conductive metal-containing particles including donor-doped metal oxides, metal oxides containing oxygen deficiencies, and conductive nitrides, carbides, and bromides. Specific examples of particularly useful particles include conductive $SnO_2$, $In_2O_3$, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103; 4,394,441; 4,416,963; 4,418,141; 4,431,764; 4,495,276; 4,571,361; 4,999,276; 5,122,445; and 5,368,995.

2) fibrous electronic conductive powders comprising, for example, antimony-doped tin oxide coated onto non-conductive potassium titanate whiskers as described in U.S. Pat. Nos. 4,845,369 and 5,166,666 and antimony-doped tin oxide fibers or whiskers as described in U.S. Pat. Nos. 5,719,016 and 5,0731,119.

3) the electric conductive polyacetylenes, polythiophenes, and polypyrroles of U.S. Pat. Nos. 4,237,194; 5,370,981, and Japanese Patent Applications 2282245 and 2282248.

For the purpose of the present invention, specific examples of particularly preferred electrically-conductive agents for use in the second electrically-conductive layer include, zinc antimonate particles such as Celnax CX-Z from Nissan Chemical Co., antimony-doped tin oxide granular particles and acicular particles such as SN100D and FS-10D, respectively, from Ishihara Sangyo Kaisha Ltd. or electronic conductive polythiophene such as the commercially available thiophene-containing polymer supplied by Bayer Corporation as Baytron P. These conductive agents are unaffected by film processing solutions and provide excellent antistatic properties even when used in low concentrations.

When the second electrically-conductive layer is overcoated with a barrier layer or a protective overcoat which prevents the diffusion of film processing solutions into the second conductive layer then the conductive agent employed does not have to be limited to those materials whose conductive properties are inherently stable towards photographic processing. In this case, the conductive agents suitable for use in the second electrically-conductive layer also include the ionic conductive agents described above for use in the first electrically-conductive layer such as simple inorganic salts, alkali metal salts of surfactants, ionic conductive polymers, polymeric electrolytes containing alkali metal salts, and colloidal metal oxide sols (stabilized by metal salts). Additional suitable conductive agents include colloidal gels of vanadium pentoxide or silver-doped vanadium pentoxide. Suitable materials for use in the barrier layer or protective overcoat include acrylic and cellulose ester resins, polyurethanes, and the latex barrier polymers described in U.S. Pat. No. 5,006,451.

U.S. Pat. No. 5,747,232 describes a motion imaging film containing a carbon black-containing backing layer and a process surviving conductive subbing layer. The carbon black-containing backing layer provides both antihalation and antistatic protection for the unprocessed film. However, this layer is not transparent. In addition, this layer must be removed using a process that involves soaking the film in alkali solution, scrubbing the backing layer, and rinsing with water. This carbon black removal process, which takes place prior to image development, is both tedious and environmentally undesirable since large quantities of water are utilized in this film processing step. In addition, in order to facilitate removal during film processing, the carbon black-containing layer is not highly adherent to the film support and may dislodge during various film manufacturing operations such as film slitting and film perforating. The '232 patent did not recognize the particular problem that is addressed by the present invention and, therefore, although it relates to the use of two conductive layers, the resistivity requirements for these two conductive layers before and after film processing was not as critical as in the present invention. In addition, the use of a non-transparent carbon black conductive agent that must be physically removed from the film during processing is undesirable for the purpose of the present invention.

In an alternative embodiment, the photographic element contains a transparent electrically-conductive layer containing a first electrically-conductive agent and a second electrically-conductive agent. The said electrically-conductive layer has an electrical resistivity of less than $1\times10^9$ Ω/□ before film processing and has an electrical resistivity of between $1\times10^9$ Ω/□ and $1\times10^{11}$ Ω/□ after film processing. The first conductive agent is one in which the conductive properties of the material do not survive film processing. The second conductive agent is one in which the conductive properties of the material are inherently stable toward photographic processing solutions (i.e., the conductive properties are substantially unaffected by film processing).

Conductive agents suitable for use as the first conductive agent include ionic conductive agents such as simple inorganic salts, alkali metal salts of surfactants, ionic conductive polymers, polymeric electrolytes containing alkali metal salts, and colloidal metal oxide sols (stabilized by metal salts). Additional materials suitable as the first conductive agent include colloidal gels of vanadium pentoxide or silver-doped vanadium pentoxide.

Conductive agents suitable for use as the second conductive agent include:

1) electronic conductive metal-containing particles including donor-doped metal oxides, metal oxides containing oxygen deficiencies, and conductive nitrides, carbides, and bromides. Specific examples of particularly useful particles include conductive $SnO_2$, $In_2O_3$, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103; 4,394,441; 4,416,963; 4,418,141; 4,431,764; 4,495,276; 4,571,361; 4,999,276; 5,122,445; and 5,368,995.

2) fibrous electronic conductive powders comprising, for example, antimony-doped tin oxide coated onto non-conductive potassium titanate whiskers as described in U.S. Pat. Nos. 4,845,369 and 5,166,666 and antimony-doped tin oxide fibers or whiskers as described in U.S. Pat. Nos. 5,719,016 and 5,0731,119.

3) the electric conductive polyacetylenes, polythiophenes, and polypyrroles of U.S. Pat. Nos. 4,237,194; 5,370,981, and Japanese Patent Applications 2282245 and 2282248.

Specific examples of particularly preferred electrically-conductive agents for use as the second electrically-conductive agent include, zinc antimonate particles such as Celnax CX-Z from Nissan Chemical Co., antimony-doped tin oxide granular particles and acicular particles such as SN100D and FS-10D, respectively, from Ishihara Sangyo Kaisha Ltd. or electronic conductive polythiophene such as the commercially available thiophene-containing polymer supplied by Bayer Corporation as Baytron P.

The amount of the conductive agent used in the electrically-conductive layers of the invention can vary widely depending on the conductive agent employed. For example, useful amounts range from about 0.5 mg/m$^2$ to about 1000 mg/m$^2$, preferably from about 1 mg/m$^2$ to about 500 mg/m$^2$. Polymeric binders useful in the electrically-conductive layers include any of the polymers commonly used in the coating art, for example, interpolymers of ethylenically unsaturated monomers, cellulose derivatives, polyurethanes, polyesters, hydrophilic colloids such as gelatin, polyvinyl alcohol, polyvinyl pyrrolidone, and others.

In addition to the electrically-conductive agent(s) and polymeric binder, the electrically-conductive layers of the invention may include; crosslinking agents, coating aids and surfactants, dispersing aids, coalescing aids, biocides, matte particles, waxes and other lubricants.

The electrically-conductive layers of the invention may be applied from either aqueous or organic solvent coating formulations using any of the known coating techniques such as roller coating, gravure coating, air knife coating, rod coating, extrusion coating, blade coating, curtain coating, slide coating, and the like. After coating, the layers are generally dried by simple evaporation, which can be accelerated by known techniques such as convection heating. Known coating and drying methods are described in further detail in Research Disclosure No. 308119, Published December 1989, pages 1007 to 1008.

The present invention will now be described in detail with reference to specific examples, however, the present invention should not be limited to these examples.

EXAMPLES 1 TO 7

Preparation of First Electrically-conductive Layer

The following transparent, conductive layers were applied onto a 120 $\mu$m thick polyester support that had been previously subbed with a terpolymer latex of acrylonitrile, vinylidene chloride, and acrylic acid. These conductive layers were then overcoated with an abrasion resistant overcoat containing 70 weight % Sancure 898 aqueous dispersible polyurethane (supplied by B.F. Goodrich Co.) and 30 weight % gelatin that was applied at a total dry coating weight of 1000 mg/m$^2$. This overcoat does not prevent the penetration of film processing solutions into the underlying conductive layer. The samples were processed in a motion picture color print film processor. The electrical resistivity of the samples before and after film processing was measured using the procedures described in R. A. Elder, "Resistivity Measurements on Buried Conductive Layers", EOS/ESD Symposium proceedings, September 1990, pages 251–254.

TABLE 1

| Coating | Conductive agent (mg/m$^2$) | Polymer Binder (mg/m$^2$) | Electrical Resistivity Before Processing (Ω/□) | Electrical Resistivity After Processing (Ω/□) |
|---|---|---|---|---|
| Example 1 | trimethyl ammonium vinylbenzyl chloride copolymer latex* (240) | poly(acrylonitrile-vinylidene chloride) cationic latex (160) | $3.0 \times 10^7$ | $>3 \times 10^{12}$ |
| Example 2 | trimethyl ammonium vinylbenzyl chloride latex* (360) | poly(acrylonitrile-vinylidene chloride) cationic latex (160) | $1.6 \times 10^7$ | $>3 \times 10^{12}$ |
| Example 3 | Versa TL3† (200) | vinylidene chloride copolymer latex | $4.0 \times 10^8$ | $>3 \times 10^{12}$ |
| Example 4 | Ag-doped vanadium pentoxide (4) | vinylidene chloride copolymer latex | $4.0 \times 10^7$ | $>3 \times 10^{12}$ |

*- as described in U.S. Pat. No. 4,070,189

†- copolymer of sodium styrene sulfonate-maleic acid (supplied by National Starch and Chemical Co.)

The results given in Table 1 demonstrate the preparation of conductive layers that are highly conductive prior to film processing (electrical resistivity values less than $1\times10^9$ Ω/□) and are essentially rendered nonconductive after film processing (electrical resistivity greater than $3\times10^{12}$ after processing) and are therefore useful in the preparation of the first electrically-conductive layer of the invention.

Preparation of Second Electrically-conductive Layer

A transparent, conductive layer was applied onto a 120 $\mu$m thick polyester support that had been previously subbed with a terpolymer latex of acrylonitrile, vinylidene chloride, and acrylic acid. This conductive layer comprised 80 weight % Celnax CX-Z conductive zinc antimonate particles (supplied by Nissan Chemical Co.) and 20 weight % gelatin at a total dry coating weight of 300 mg/M$^2$. This conductive layer was then overcoated with a crosslinked gelatin layer applied at a total dry coating weight of 4000 mg/M$^2$ in order to simulate overcoating the conductive layer with a photographic emulsion layer. This sample (Example 5) was processed in a motion picture color print film processor and the electrical resistivity of the sample was measured before and after processing as described previously. This sample gave an electrical resistivity value before and after processing equal to $5\times10^9$ Ω/□ and demonstrates that such a layer is useful in the preparation of the second electrically-conductive layer of the invention.

Preparation of Film Containing a First Electrically-conductive Layer and a Second Electrically-conductive Layer A 120 $\mu$m thick polyester support that was previously subbed on both sides with a terpolymer latex of acrylonitrile, vinylidene chloride, and acrylic acid was coated on one side with a first electrically-conductive layer. An abrasion resistant overcoat containing 70 weight % Sancure 898 aqueous dispersible polyurethane (supplied by B.F. Goodrich Co.) and 30 weight % gelatin that was applied at a total dry coating weight of 1000 mg/m$^2$ was then applied over the first electrically-conductive layer. On the opposite side to these two layers, a second electrically-conductive layer was applied. A crosslinked gelatin layer applied at a total dry coating weight of 4000 mg/M$^2$ was then coated over the second electrically-conductive layer. These samples were then processed as described previously. The electrical resistivity for the film was measured before and after processing and the results are reported in Table 2.

TABLE 2

| Sample | 1st conductive layer | 2nd conductive layer | Electrical Resistivity Before Processing (Ω/□) | Electrical Resistivity Before Processing (Ω/□) |
|---|---|---|---|---|
| Example 6 | same as Example 2 | same as Example 5 | $2.0 \times 10^7$ | $2.0 \times 10^9$ |
| Example 7 | same as Example 4 | same as Example 5 | $1.5 \times 10^7$ | $1.5 \times 10^9$ |

The results show that a film containing a transparent, first conductive layer and a transparent, second conductive layer of the invention can provide extremely conductive properties before film processing where this is needed to help prevent static related problems in high speed manufacturing operations and moderate conductive properties after processing so that film sticking is reduced.

The invention has been described in detail with particular reference to certain preferred embodiments thereof, but it will be understood that variations and modifications can be effected within the spirit and scope of the invention.

What is claimed is:

1. A photographic element comprising:

a support;

at least one silver halide image forming layer superposed on the support;

a first transparent electrically conductive layer comprising an electrical resistivity of less than $1\times10^9$ Ω/□ before photographic processing and an electrical resistivity of greater than $1\times10^{11}$ Ω/□ after photographic processing; and a second transparent electrically conducting layer comprising an electrical resistivity of between $1\times10^9$ Ω/□ and $1\times10^{11}$ Ω/□ both before and after photographic processing.

2. The photographic element of claim 1 wherein the support comprises cellulose nitrate film, cellulose acetate film, poly(vinyl acetal) film, polystyrene film, poly(ethylene terephthalate) film, poly(ethylene naphthalate) film, polycarbonate film, glass, metal, paper or polymer-coated paper.

3. The photographic element of claim 1 wherein the first electrically conductive layer comprises an electrically-conductive agent dispersed in a binder, the electrically conductive agent comprises inorganic salts, alkali metal salts, ionic conductive polymers, polymeric electrolytes containing alkali metal salts or colloidal metal oxide sols.

4. The photographic element of claim 3 wherein the binder comprises interpolymers of ethylenically unsaturated monomers, cellulose derivatives, polyurethanes, polyesters, hydrophilic colloids, polyvinyl alcohol or polyvinyl pyrrolidone.

5. The photographic element of claim 3 wherein the electrically-conductive agent comprises an amount from 0.5 mg/m$^2$ to about 1000 mg/m$^2$.

6. The photographic element of claim 3 wherein the first electrically-conductive layers further comprises crosslinking agents, coating aids, surfactants, dispersing aids, coalescing aids, biocides, matte particles or lubricants.

7. The photographic element of claim 1 wherein the second electrically conductive layer comprises an electrically-conductive agent dispersed in a binder, the electrically conductive agent selected from the group consisting of electronic conductive metal-containing particles, metal oxides containing oxygen deficiencies, conductive nitrides, conductive carbides, conductive bromides, fibrous electronic conductive powders, conductive polyacetylenes, conductive polythiophenes and conductive polypyrroles.

8. The photographic element of claim 7 wherein the binder comprises interpolymers of ethylenically unsaturated monomers, cellulose derivatives, polyurethanes, polyesters, hydrophilic colloids, polyvinyl alcohol or polyvinyl pyrrolidone.

9. The photographic element of claim 7 wherein the electrically-conductive agent comprises an amount from 0.5 mg/m$^2$ to about 1000 mg/m$^2$.

10. The photographic element of claim 7 wherein the second electrically-conductive layer further comprises crosslinking agents, coating aids, surfactants, dispersing aids, coalescing aids, biocides, matte particles or lubricants.

11. The photographic element of claim 1 wherein the second electrically conductive layer comprises an electrically-conductive agent dispersed in a binder, the electrically conductive agent comprising inorganic salts, alkali metal salts, ionic conductive polymers, polymeric electrolytes containing alkali metal salts or colloidal metal oxide sols and said photographic element further comprises a barrier layer overlying said second conductive layer.

12. The photographic element of claim 11 wherein the binder comprises interpolymers of ethylenically unsaturated monomers, cellulose derivatives, polyurethanes, polyesters, hydrophilic colloids, polyvinyl alcohol or polyvinyl pyrrolidone.

13. The photographic element of claim 11 wherein the electrically-conductive agent comprises an amount from 0.5 mg/m$^2$ to about 1000 mg/m$^2$.

14. The photographic element of claim 11 wherein the second electrically-conductive layers further comprises crosslinking agents, coating aids, surfactants, dispersing aids, coalescing aids, biocides, matte particles or lubricants.

15. A photographic element comprising:

a support;

at least one silver halide image forming layer superposed on the support;

a transparent electrically conductive layer comprising a first conductive agent and a second conductive agent dispersed in a binder wherein said electrically conductive layer has an electrical resistivity of less than $1\times10^9$ Ω/□ before photographic processing and an electrical resistivity of between $1\times10^9$ Ω/□ and $1\times10^{11}$ Ω/□ after photographic processing.

16. The photographic element of claim 15 wherein the support comprises cellulose nitrate film, cellulose acetate film, poly(vinyl acetal) film, polystyrene film, poly(ethylene terephthalate) film, poly(ethylene naphthalate) film, polycarbonate film, glass, metal, paper or polymer-coated paper.

17. The photographic element of claim 15 wherein the first electrically-conductive agent comprises inorganic salts, alkali metal salts, ionic conductive polymers, polymeric electrolytes containing alkali metal salts or colloidal metal oxide sols.

18. The photographic element of claim 15 wherein the second electrically conductive agent comprises electronic conductive metal-containing particles, metal oxides containing oxygen deficiencies, conductive nitrides, conductive carbides, conductive bromides, fibrous electronic conductive powders, conductive polyacetylenes, conductive polythiophenes or conductive polypyrroles.

19. The photographic element of claim 15 wherein the binder comprises interpolymers of ethylenically unsaturated monomers, cellulose derivatives, polyurethanes, polyesters, hydrophilic colloids, polyvinyl alcohol or polyvinyl pyrrolidone.

20. The photographic element of claim 15 wherein the second electrically-conductive layers further comprises crosslinking agents, coating aids, surfactants, dispersing aids, coalescing aids, biocides, matte particles or lubricants.

21. The photographic element of claim 4 wherein the hydrophilic colloid is gelatin.

22. The photographic element of claim 12 wherein the hydrophilic colloid is gelatin.

23. The photographic element of claim 19 wherein the hydrophilic colloid is gelatin.

* * * * *